United States Patent [19]

Röck et al.

[11] Patent Number: 4,775,202

[45] Date of Patent: Oct. 4, 1988

[54] DEVICE FOR FASTENING THE FRONT PLATE OF A DRAWER

[75] Inventors: Erich Röck; Josef Brunner, both of Höchst, Austria

[73] Assignee: Julius Blum Gesellschaft m.b.H., Höchst, Austria

[21] Appl. No.: 38,314

[22] Filed: Apr. 14, 1987

[30] Foreign Application Priority Data

May 28, 1986 [AT] Austria ..... 1436/86

[51] Int. Cl.[4] ..... A47B 88/00

[52] U.S. Cl. ..... 312/263; 312/330 R; 403/297

[58] Field of Search ..... 312/263, 330 R; 403/297, 249, 362

[56] References Cited

U.S. PATENT DOCUMENTS 4,120,551 10/1978 Godtschalck ..... 312/330 R 4,131,376 12/1978 Busse ..... 403/297 X

*Primary Examiner*—Joseph Falk

*Attorney, Agent, or Firm*—Wenderoth, Lind & Ponack

[57] ABSTRACT

A device for fastening the front plate of a drawer to metal drawer frames includes, for each side of the drawer, a fastened to the front plate and of angular configuration, when viewed from the top, with a holding flange aligned parallel to the front plate. A supporting member is formed at the front end of the drawer frame. The supporting has a U-shaped configuration when viewed from the top. The flange of the holding member that is aligned parallel to the front plate is insertable into the U-shaped profile of the supporting member. Each holding member has a bracing flap which is by means of a bracing screw pressable against a supporting flange or against a flange of the supporting member lying opposite the supporting flange of the U-shaped profile.

9 Claims, 2 Drawing Sheets

DEVICE FOR FASTENING THE FRONT PLATE OF A DRAWER

FIELD AND BACKGROUND OF THE INVENTION

The invention relates to a fastening device for mounting the front plate of a drawer, holding and including, for each side of the drawer, a fastened to the front plate and being of angular configuration, when viewed from the top, with a holding flange aligned parallel to the front plate. The holding flange engages behind a supporting flange of a supporting member. The supporting flange is aligned parallel to the front plate and formed at the front of a respective drawer frame. The holding member is clampable to the supporting member that has a U-shaped configuration at least in some regions thereof, when viewed from the top. The flange of the holding member that is aligned parallel to the front plate is insertable into the U-shaped profile of the supporting member.

For assembling a drawer, the front plate should be quickly engageable and fastenable to the drawer frames which form the side walls of the drawer. The arrangement should provide the possibility of adjustment so that the front plate is movable at least in the vertical direction and laterally towards the sides of the drawer to obtain equal and regular gaps between superjacently arranged drawers and alignment of the sides of such drawers.

SUMMARY OF THE INVENTION

It is the object of the invention to provide a fastening device for a very simple drawer in which only few parts are required for rapidly engaging and fastening the front plate to the drawer frames.

According to the invention this is achieved in that each supporting member is part of a metal drawer frame and that each holding member comprises a bracing flap which can, by means of a bracing screw, be pressed to the supporting flange or to the flange of the supporting member which lies opposite the supporting flange of the U-shaped profile of the supporting member.

It has been found to be particularly advantageous to combine holding members of plastic material and drawer frames of metal.

Particularly with metal drawer frames it is not necessary to provide separate supporting members, because they can be formed directly with and as part of the drawer frames.

The holding members are advantageously insertable into the supporting members from the top. An eccentric may be provided at the lower side of supporting member or at the drawer frame, so that the holding members abut against the eccentrics by means of a projections or the like. The eccentric can determine a zero-position of the height of the front plate. Hence, a vertical adjustment of the front plate is not necessary in most cases, whereby mounting of the front plates is substantially accelerated.

It is advantageously provided that the U-shaped profiles of the supporting members extends substantially over the full height of the drawer frames.

A further embodiment of the invention provides that the bracing flaps are arranged in recesses in the flanges of the supporting members which are aligned parallel to the front plate.

The bracing flaps may be injection molded as integral part with the holding members, a gap being provided into which the bracing screw being screwed into a gap provided between each holding member and respective bracing flap.

BRIEF DESCRIPTION OF THE DRAWINGS

In the following an embodiment of the invention will be described in more detail which reference to the accompanying drawings, in which.

DESCRIPTION OF THE PREFERRED EMBODIMENT

Figure 1:
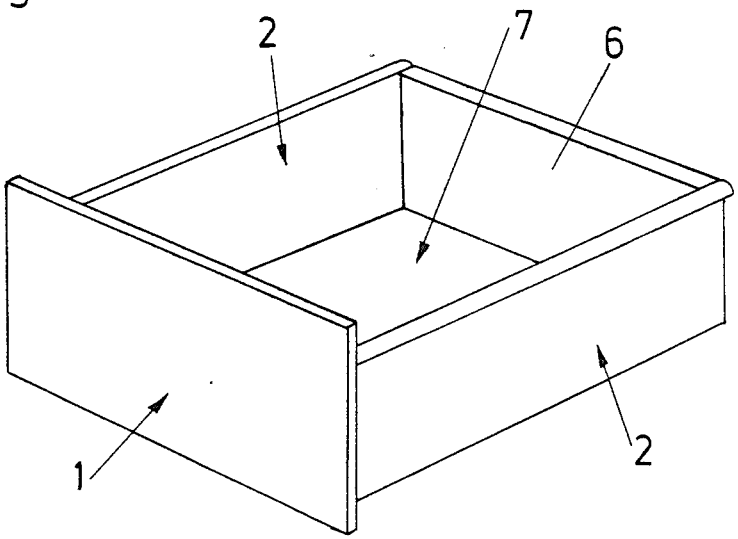
FIG. 1 is a perspective view of a drawer with a fastening device according to the invention.

The essential parts of drawer are front plate 1, the two drawer frames 2, which also form pull-out rails of a pull-out guide assembly in the illustrated embodiment, rear wall 6 and drawer bottom 7.

The essential parts of the fastening device for the front plate 1 are holding members 3 and supporting members 8.

Figure 6:
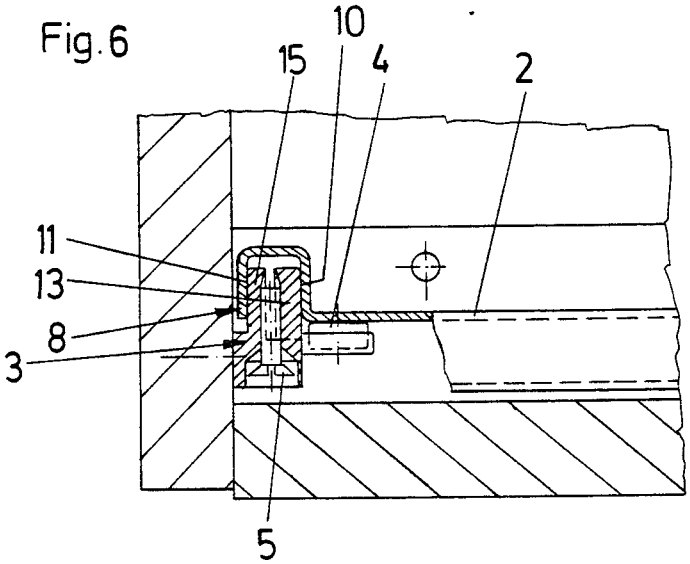
FIG. 6 is a sectional view along line I—I of FIG. 5.
Figure 2:
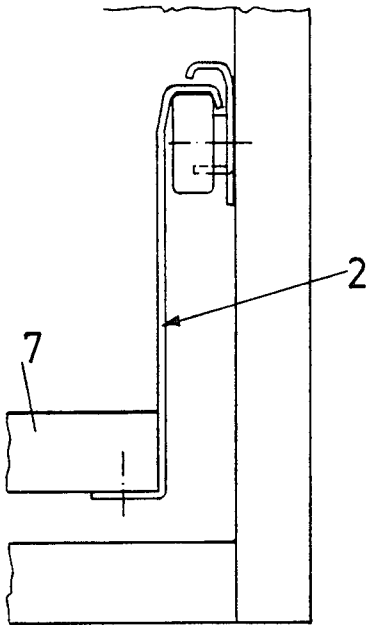
FIG. 2 is a sectional view of a frame of the drawing, in a center region thereof, an adjacent side wall of a body of furniture also be shown.
Figure 3:
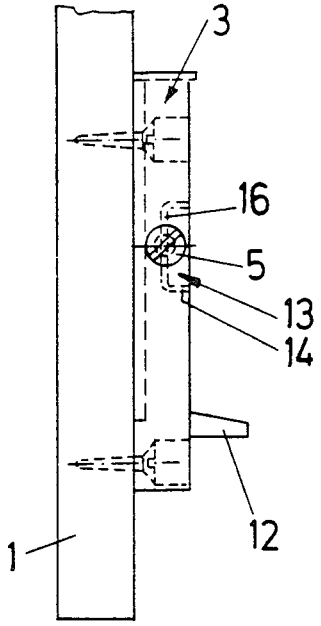
FIG. 3 is a side view of a front plate of the drawer with a holding member.
Figure 4:
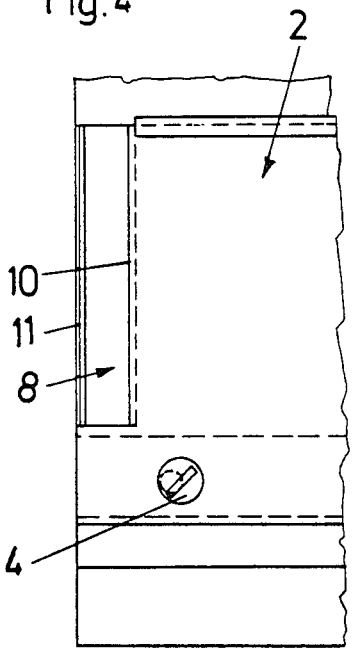
FIG. 4 is a side view of a front region of the drawer frame and a supporting member thereof.
Figure 5:
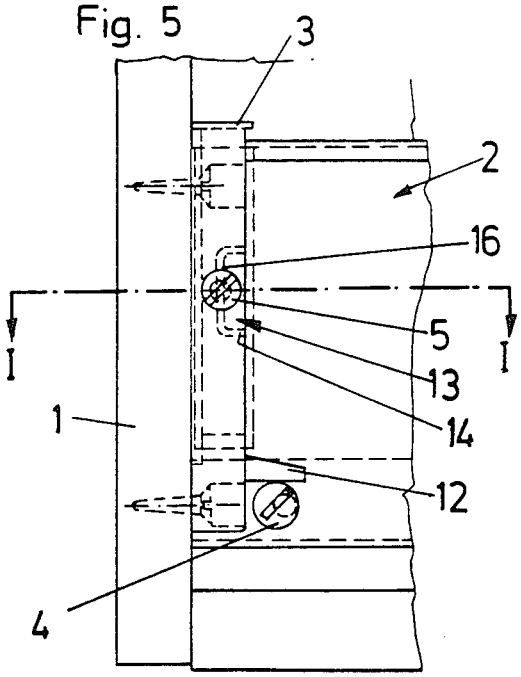
FIG. 5 is a side view of the front end of the drawer frame, the front plate being held at the drawer frame.

As can particularly be seen from FIG. 6, each supporting member 8 is formed directly from the front end of the respective drawer frames 2 and has a U-shaped configuration, including when viewed from the top, a supporting flange 11 aligned parallel to the front plate 1 and a flange 10 parallel to supporting flange 11.

Each holding member 3 is of angular configuration, when viewed from the top, including a holding flange 15 aligned parallel to the front plate 1.

In the drawings, only one side of the drawer is shown, i.e. one holding member 3 and one supporting member 8. It is obvious that the same members are provided at the other side of the drawer in an analogous manner.

An eccentric 4 is arranged at the lower side of each drawer frame 2. When the holding members 3 are inserted into the respective supporting members 8, a stop 12 of each holding member 3 abuts the abuts the respective eccentric 4, thus providing automatic zero-positioning. The front plate 1 may, if necessary, be lifted or lowered with respect to the drawer frames 2 by means of the respective eccentrics 4.

Each holding member 3 has in the center region thereof a bracing flap or member 13 that is pressable against the respective flange 10 of the supporting member 8 by means of a bracing screw 5. This allows quick fixing of the holding members 3 within the U-shaped profiles of the supporting members 8.

The adjustment or positioning of the front plate 1 in opposite lateral direction is possible because of a lateral clearance provided between each holding member 3 and the web connecting flanges 10, 11 of the respective supporting member 8.

Each bracing flag 13 advantageously is positioned in a recess 14 of the flanges 15 of the respective holding parts 3 that is aligned parallel to the front plate 1. Each holding part 3 may be injection molded as an integral part with the respective bracing 13, the bracing screw 5 being screwed into a gap 16 therebetween. Similar bracing means are known from hinge casings.

What is claimed is:

1. A fastening device for connecting a front plate of a drawer to metal side frames of the drawer, said fastening device comprising, for each side of the drawer:

a holding member to be fastened to the front plate and having an angular configuration when viewed from the top including a holding flange extending in a direction to be parallel to the front plate;

a supporting member formed integrally with the respective metal drawer frame at the front end thereof, at least a portion of said supporting member having a U-shaped configuration when viewed from the top including a supporting flange extending in a direction to be parallel to the front plate and a further flange spaced from said supporting flange;

said holding flange being insertable into said U-shaped configuration between said supporting flange and said further flange thereof;

said holding member having a bracing member insertable with said holding flange into said U-shaped configuration between said supporting flange and said further flange; and means for pressing said bracing member away from said holding member and into abutment with one of said supporting flange or said further flange, and thereby for clamping said holding member to said supporting member, said pressing means comprising a bracing screw screwably inserted between said holding member and said bracing member and extending in a direction parallel to said holding flange and said supporting flange and to be parallel to the front plate.

2. A device as claimed in claim 1, wherein said holding member is formed of a plastic material.

3. A device as claimed in claim 2, wherein said bracing member is formed integrally with said holding member by injection molding of said plastic material.

4. A device as claimed in claim 1, wherein said holding flange of said holding member is insertable into said U-shaped configuration of said supporting member from the top thereof.

5. A device as claimed in claim 1, wherein said U-shaped configuration of said supporting member extends over substantially the entire height of said metal drawer frame.

6. A device as claimed in claim 1, wherein said holding flange of said holding member has therein a recess, and said bracing member is positioned within said recess.

7. A device as claimed in claim 6, further comprising a gap between said bracing member and said holding flange, said bracing screw being screwably inserted into said gap.

8. A device as claimed in claim 1, further comprising an eccentric rotatably mounted on a lower portion of the front end of said metal drawer frame, and a projection extending from said holding member and abutting said eccentric when said holding flange is inserted into said U-shaped configuration, such that rotation of said eccentric will vary the vertical position of said holding member, and thereby the front plate, relative to said metal drawer frame.

9. A device as claimed in claim 1, wherein said U-shaped configuration further includes a web connecting said supporting flange and said further flange, and said holding flange is laterally adjustable relative to said web.

* * * * *